US005713274A

United States Patent [19]

Kawai et al.

[11] Patent Number: 5,713,274

[45] Date of Patent: Feb. 3, 1998

[54] STENCIL DISCHARGING APPARATUS

[75] Inventors: Muneaki Kawai; Terutoshi Nakao, both of Tokyo, Japan

[73] Assignee: Riso Kagaku Corporation, Tokyo, Japan

[21] Appl. No.: 792,703

[22] Filed: Jan. 29, 1997

Related U.S. Application Data

[63] Continuation of Ser. No. 560,120, Nov. 17, 1995, abandoned.

[30] Foreign Application Priority Data

Nov. 18, 1994 [JP] Japan ..... 6-285154
Nov. 18, 1994 [JP] Japan ..... 6-285155
Nov. 18, 1994 [JP] Japan ..... 6-285156

[51] Int. Cl.[6] ..... B41L 13/06

[52] U.S. Cl. ..... 101/114; 101/116

[58] Field of Search ..... 101/114, 116–120, 101/477, 479, 483

[56] References Cited

U.S. PATENT DOCUMENTS 4,339,293 7/1982 Takahashi et al. ..... 101/114
4,846,057 7/1989 Endo et al. ..... 101/477
5,090,310 2/1992 Motoe ..... 101/114
5,133,919 7/1992 Hasegawa et al. ..... 101/114
5,323,699 6/1994 Motoe et al. ..... 101/477
5,323,706 6/1994 Sugawara ..... 101/477
5,564,335 10/1996 Motoe et al. ..... 101/114

FOREIGN PATENT DOCUMENTS 2339495 12/1976 France .
2196901 5/1988 United Kingdom .

*Primary Examiner*—Ren Yan
*Attorney, Agent, or Firm*—Sughrue, Mion, Zinn, Macpeak & Seas, PLLC

[57] ABSTRACT

A stencil discharging apparatus for a stencil printing machine in which a stencil is used, the stencil discharging apparatus includes: a conveyer for conveying the stencil to be discharged; a used-stencil accommodating section having an opening and a stencil accommodating space in which the stencil conveyed by the conveyer is accommodated; and a compressing board pivotally provided, wherein the compressing board presses the stencil accommodated in the stencil accommodating space toward the opposite of the opening of the used-stencil accommodating section in accordance with moving the compressing board in the stencil accommodating space.

6 Claims, 11 Drawing Sheets

STENCIL DISCHARGING APPARATUS

This is a continuation of application Ser. No. 08/560,120 filed Nov. 17, 1995, now abandoned.

BACKGROUND OF THE INVENTION

1. Field of the Invention

This invention relates to a stencil discharging apparatus provided, for instance, for a stencil printing machine, which compresses and accommodates a stencil or stencils delivered thereto, for instance, from the printing section of the printing machine.

2. Description of the Related Art

In general, a rotary stencil printing machine has a printing cylindrical drum which is partially ink-transmissive (hereinafter referred to as "a drum", when applicable). Ink supplying means is provided inside the drum, to supply printing ink to the inner circumferential surface of the drum. A printing stencil is wound on the outer circumferential surface of the drum. Sheet pressing means for pressing a printing sheet against the drum is provided near the drum. As the drum is rotated, a printing sheet is supplied into the space between the drum and the sheet pressing means. The pressing means presses the printing sheet against the stencil wound on the drum. The printing ink supplied to the inner circumferential surface of the drum is transferred through the drum and the perforated image area of the stencil onto the printing sheet. Thus, printing data, such as characters, formed in the perforated image area of the stencil are printed on the printing sheet; that is, a print has been obtained. After the printing operation, stencil discharging means provided near the drum is operated to discharge the stencil thus used. The stencil discharging means includes: separating claws, conveying rollers, and a used-stencil accommodating section.

Stencil discharging means of this type has been disclosed, for instance, by Japanese Patent Application Laid-open No. Hei. 6-199029. The stencil discharging means, as shown in FIG. 12, includes a used-stencil accommodating section 201 with an inlet 203; and a pair of conveying rollers 202. In the stencil discharging means, the conveying rollers 202 are driven to convey a used stencil S through the inlet 203 into the used-stencil accommodating section 201. During this operation, the stencil S is caused to strike against a stencil compressing board 204 near the inlet 203, so that it is compressed being folded zig-zag in the space 205 which is defined in the used-stencil accommodating section by the stencil compressing board 204. Under this condition, the next used stencil is conveyed into the used-stencil accommodating section 201 in the same manner, so that the used-stencil which has been compressed before is further compressed.

As the number of used stencils S conveyed into the space 205 increases, the pressure applied to the used stencils S detained in the space by the stencil compressing board 204 is increased. When the pressure overcomes the stencil holding force of the board 204 which is attribute to the weight of the board 204, as shown in FIG. 13, the stencil compressing board 204 is swung back towards the inner part of the used-stencil accommodating section 201, so that the used-stencils are moved towards the inner part of the used-stencil accommodating section 201 while being compressed.

The used stencil which has been removed from the printing cylindrical drum is stained with the printing ink. Hence, when conveyed, the used stencil may be stuck to the stencil conveying mechanism by the adhesion of the printing ink. On the other hand, different stencils have different quantities of printing ink, and therefore not all the stencils are stored in the used-stencil accommodating section in the same manner. In addition, some used stencils are not sufficiently compressed by the stencil conveying roller and the stencil compressing board. Hence, some of them may be restored, thus being caught in the stencil conveying path. This difficulty may adversely affect the next stencil discharging operation.

SUMMARY OF THE INVENTION

Accordingly, an object of the invention is to provide a stencil discharging apparatus which is able to positively compress and accommodate a used stencil or used stencils which are stained with printing ink or the like.

According to a first aspect of the invention, there is provided a stencil discharging apparatus for a stencil printing machine in which a stencil is used, the stencil discharging apparatus includes: conveying means for conveying the stencil to be discharged; a used-stencil accommodating section having an opening and a stencil accommodating space in which the stencil conveyed by the conveying means is accommodated; and a compressing board pivotally provided, wherein the compressing board presses the stencil accommodated in the stencil accommodating space toward the opposite of the opening of the used-stencil accommodating section in accordance with moving the compressing board in the stencil accommodating space.

According to a second aspect of the invention, there is provided a stencil discharging apparatus for a stencil printing machine in which a stencil is used, the stencil discharging apparatus,includes: conveying means for conveying the stencil to be discharged; a used-stencil accommodating section having a stencil accommodating space in which the stencil conveyed by the conveying means is accommodated; and compressing means which is moved in the stencil accommodating space of the used-stencil accommodating section, for compressing the stencil in the stencil accommodating space, wherein the width of the used-stencil accommodating section as viewed in a direction which is in parallel with the surface of the stencil being conveyed and perpendicular to a stencil conveying direction is gradually larger in a direction in which the compressing means is moved to compress the stencil.

According to a third aspect, there is provided a stencil discharging apparatus for a stencil printing machine in which a stencil is used, the stencil discharging apparatus including: conveying means for conveying the stencil to be discharged; a used-stencil accommodating section having an opening from which the stencil is received and a stencil accommodating space in which the stencil conveyed by the conveying means is accommodated; compressing means which is moved in the stencil accommodating space of the used-stencil accommodating section, for compressing the stencil in the stencil accommodating space; and means for preventing the stencil accommodated in the stencil accommodating space from moving out.

According to a fourth aspect, there is provided a stencil discharging apparatus for a stencil printing machine in which a stencil is used, the stencil discharging apparatus including: conveying means for conveying the stencil to be discharged; a used-stencil accommodating section having a stencil accommodating-space in which the stencil conveyed by the conveying means is accommodated; and compressing means which is moved across the conveying means in the stencil accommodating space of the used-stencil accommodating section, for compressing the stencil in the used-stencil accommodating space, wherein the stencil accommodating space is substantially conformable with the locus of the compressing means is moved.

A stencil to be discarded is conveyed by the conveying means, and accommodated in the stencil accommodating space in the used-stencil accommodating section. The compressing means is swung about the shaft; that is, it is moved along the inner surface of the used-stencil accommodating section.

In the second aspect, the width of the used-stencil accommodating section is gradually larger in the direction in which the compressing board is moved to compress the stencils, so that the number of stencils accommodated therein is increased as much.

In the third aspect, after the compressing means compresses the stencil accommodated in the stencil accommodating space, the compressing means returns to the home position. In this operation, a used stencil may stick to the compressing means, and the sticking stencil moves toward the opening together with the compressing means. However, preventing means provided near the opening contacts with the sticking stencil, and prevents the stencil from moving out of the stencil accommodating space.

In the fourth aspect, when the compressing means moves in the stencil accommodating space toward the side opposite of to the opening, the compressing means surely presses the stencil accommodated in the stencil accommodating space since the stencil accommodating space is substantially conformable with the locus of movement of the outer end of the compressing means.

DETAILED DESCRIPTION OF THE PREFERRED EMBODIMENTS

Preferred embodiments of the invention will be described with reference to the accompanying drawings.

Figure 1:
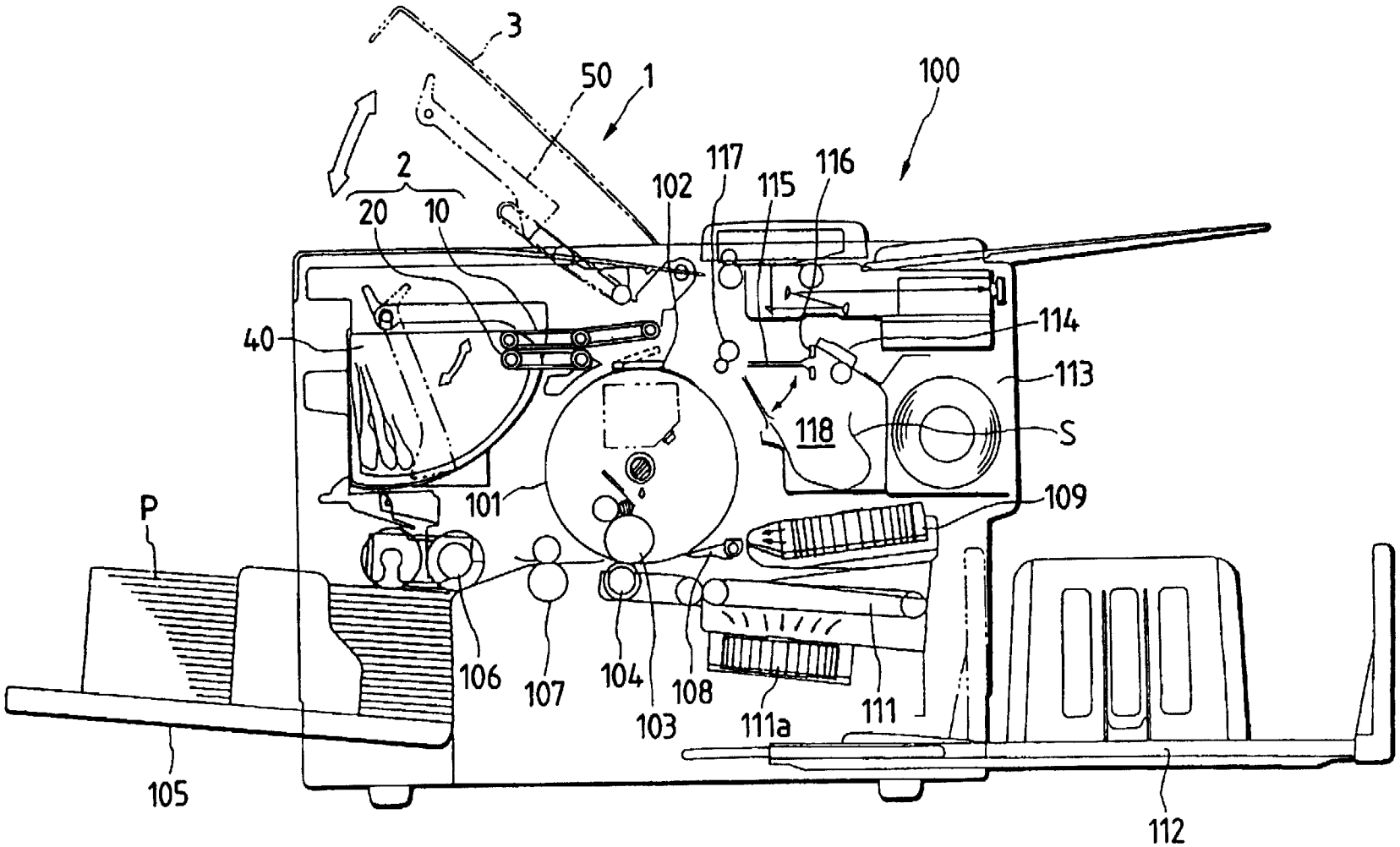
FIG. 1 is a diagram showing the arrangement of a stencil printing machine with a stencil discharging apparatus according to the invention.

FIG. 1 shows a stencil printing machine 100 with a stencil discharging apparatus which is an embodiment of the invention. The printing machine 100 has a rotary cylindrical drum 101 (hereinafter referred to merely as "a drum 101", when applicable). The drum 101 is in the form of a cylinder of multi-layer structure which is made up of a porous screen. A stencil clamping member 102 is provided on the outer circumferential surface of the drum 101, to clamp the front end of a printing stencil s to the drum 101. With the front end of the printing stencil S clamped to the drum 101 with the stencil clamping member 102, the drum 101 is turned to wind the stencil S on its outer cylindrical surface. An ink supplying unit 103 including a squeegee roll, a doctor roll, etc. is provided on an inner circumferential surface of the drum 101, to supply printing ink to the inside of the drum 101. A press roll 104 serving as pressing means is provided below the drum 101. The press roll 104 is moved vertically in synchronization with the supplying of a printing sheet P or the rotation of the drum 101, to press the printing sheet P against the drum 101.

The stencil printing machine 100 includes a sheet supplying mechanism which is designed as follows: A sheet supplying stand 105, on which printing sheets P are stacked, is provided below and left of the cylindrical drum 101. A scraper unit 106 is provided above the sheet supplying stand 105. The scraper unit 106 operates to take one printing sheet out of the stack of printing sheets P at a time and forward it. Timing rolls 107 are provided adjacent to the scraper unit 106, to convey each sheet P which has been taken out of the stack of sheets P by the scraper unit 106, to the nipping region of the drum 101 and the press roll 104.

The stencil printing machine 100 further includes a sheet discharging mechanism which is designed as follows: A separating pawl 108, and a separating fan 109 are provided below and right of the cylindrical drum 101. The separating pawl 108 approaches the front end of a printed sheet P, to separate it from the drum 101. The separating fan 109 is to enhance the separation of the printed sheet P. A sheet conveying mechanism 111 for conveying a sheet P separated from the drum 101 is provided below the separating pawl 108. The mechanism 111 is provided with sucking means 111*a* for sucking and retaining a sheet P which is conveyed. A sheet discharging stand 112 is provided downstream of the sheet conveying mechanism 111 as viewed in the sheet conveying direction. Printed sheets P are conveyed to the sheet discharging stand 112, where they are stacked.

Furthermore, as shown in FIG. 1, a stencil supplying section 113 which accommodates a roll of stencil sheet S, which is used to make printing stencils, is provided above the sheet discharging mechanism 111. The stencil sheet S is forwarded to the left in FIG. 1. A printing-stencil making unit 114 is provided adjacent to the stencil supplying section 113. The printing-stencil making unit 114 makes a printing stencil by using the stencil sheet S supplied from the stencil supplying section 113. The printing-stencil making unit 114 comprises a thermal head, and a platen roller, to form a picture in the stencil sheet S in correspondence to a given original. A guide board 115 is provided adjacent to the printing-stencil making unit 114, to guide the stencil sheet S thus processed. A cutter 116 is provided between the printing-stencil making unit 114 and the guide boards 115, to cut the stencil sheet S to obtain a printing stencil. In addition, stencil forwarding rolls 117 are provided adjacent to the guide board 115, to forward the printing stencil thus obtained. The guide board 115 is swingable about its end on the side of the sheet forwarding rolls 117. Hence, by turning the end of the guide board 115 downwardly which is on the side of the printing-stencil making unit 114, the printing stencil S can be sent into a stencil accommodating section 118.

The stencil sheet S supplied from the stencil supplying section 113 is processed by the printing-stencil making unit 114, as was described above. The stencil sheet S thus made is forwarded with stencil forwarding rolls 117. When the front end of the stencil sheet S reaches the stencil clamping member 102, the stencil clamping member 102 fixedly holds the front end of the stencil sheet S. Under this condition, the drum 101 is turned to forward the stencil sheet S. When the stencil sheet S is forwarded as much as the length of one printing stencil, the drum 101 is stopped, and then the cutter 16 is operated to cut the stencil sheet S to obtain a printing stencil. The printing stencil thus obtained is wound on the drum 101.

Now, the stencil discharging apparatus 1 will be described in detail.

As shown in FIG. 1, the stencil discharging apparatus 1 is provided above the scraper unit 106 and left of the drum 101. The stencil discharging apparatus 1 is to remove the used stencil S from the outer circumferential surface of the drum 101, and discard it. The stencil discharging apparatus 1 includes: a used-stencil conveying unit 2 which removes a used stencil from the drum 101 and conveys it; a used-stencil accommodating container 40 which accommodates used stencils S conveyed by the used-stencil conveying unit 2; and a used-stencil compressing board 50 adapted to compress the used stencil and other used stencils in the used-stencil accommodating container 40.

Figure 2:
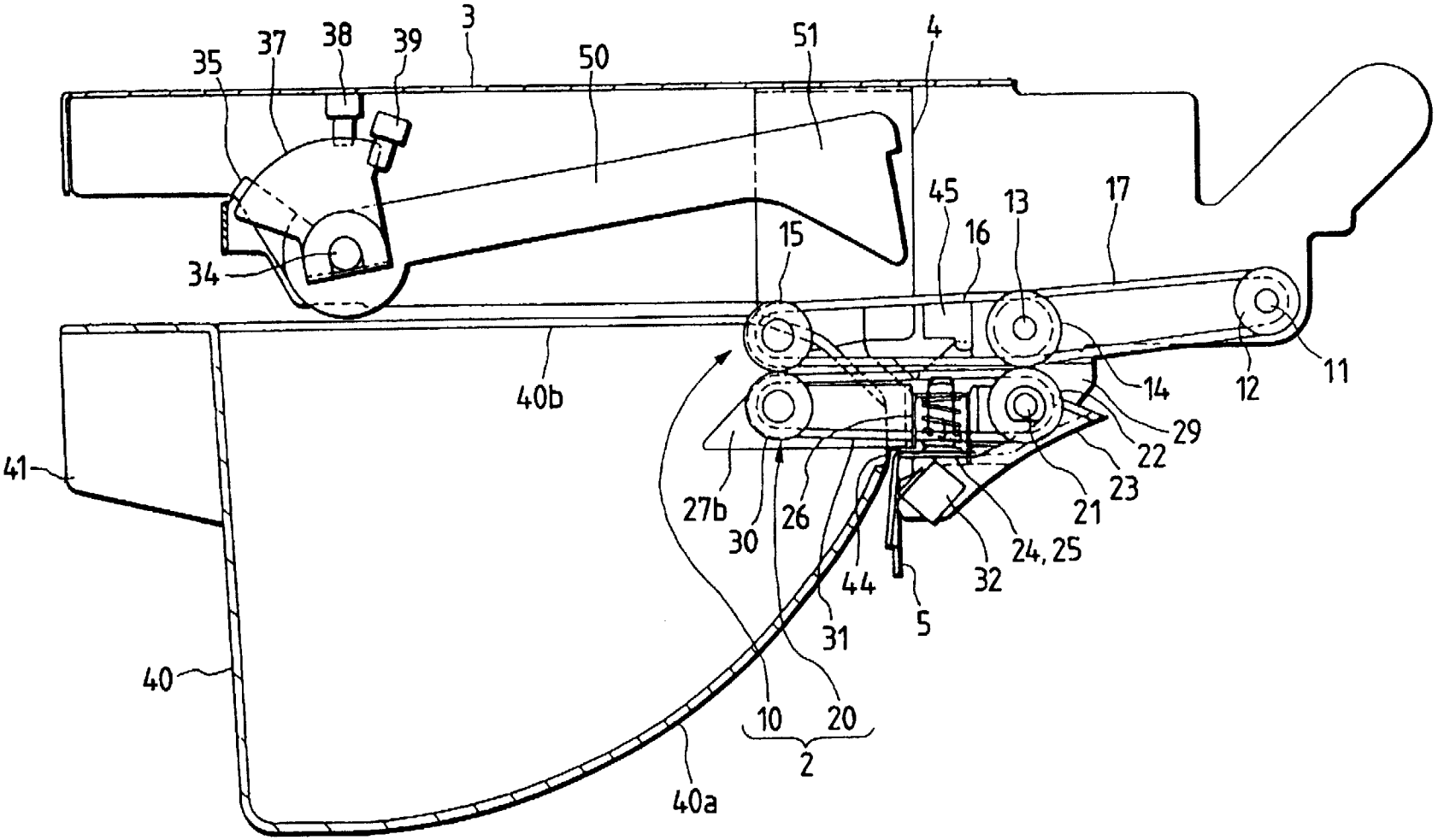
FIG. 2 is a sectional view of the stencil discharging apparatus shown in FIG. 1.

In the stencil discharging apparatus 1, the used-stencil conveying unit 2 includes first and second conveying means 10 and 20 which are each made up of a plurality of round endless belts (hereinafter referred to merely as "belts", when applicable) and a plurality of pulleys. As shown in FIGS. 1 and 2, the first conveying means 10 is mounted on a lid member 3. The lid member 3 is a lid which forms a part of the upper surface of the housing of the stencil printing machine. As shown in FIG. 1, the lid member 3 is coupled to the housing in such a manner that it is swingable about its right end.

As shown in FIG. 2, a first upper rotary shaft 11 is rotatably provided at the right end of the lid member 3. The first upper rotary shaft 11 is in parallel with the central axis of the rotary cylindrical drum 101. Four first upper pulleys 12 are mounted on the first upper rotary shaft 11 at predetermined intervals.

A second upper rotary shaft 13 is rotatably provided downstream of the first upper rotary shaft 11 as viewed in the stencil discharging direction (on the left side of the rotary shaft 11 in FIG. 2). The second upper rotary shaft 13 is in parallel with the first upper rotary shaft 11. Four second upper pulleys 14 are mounted on the second upper rotary shaft 13 at predetermined intervals. Each of the second upper pulleys 14 has two grooves, so that two belts can be laid on them.

Four third upper pulleys 15 are provided at predetermined intervals such that the third upper pulleys 15 correspond to the respective second upper pulleys 14 as viewed in the axial direction. The third upper pulleys 15 are rotatably mounted on a plurality of supporting boards 4 which are fixedly secured to the lid member 3. The rotational axes of the third upper pulleys 15 are in parallel with the above-described first and second upper rotary shafts 11 and 13.

Figure 3:
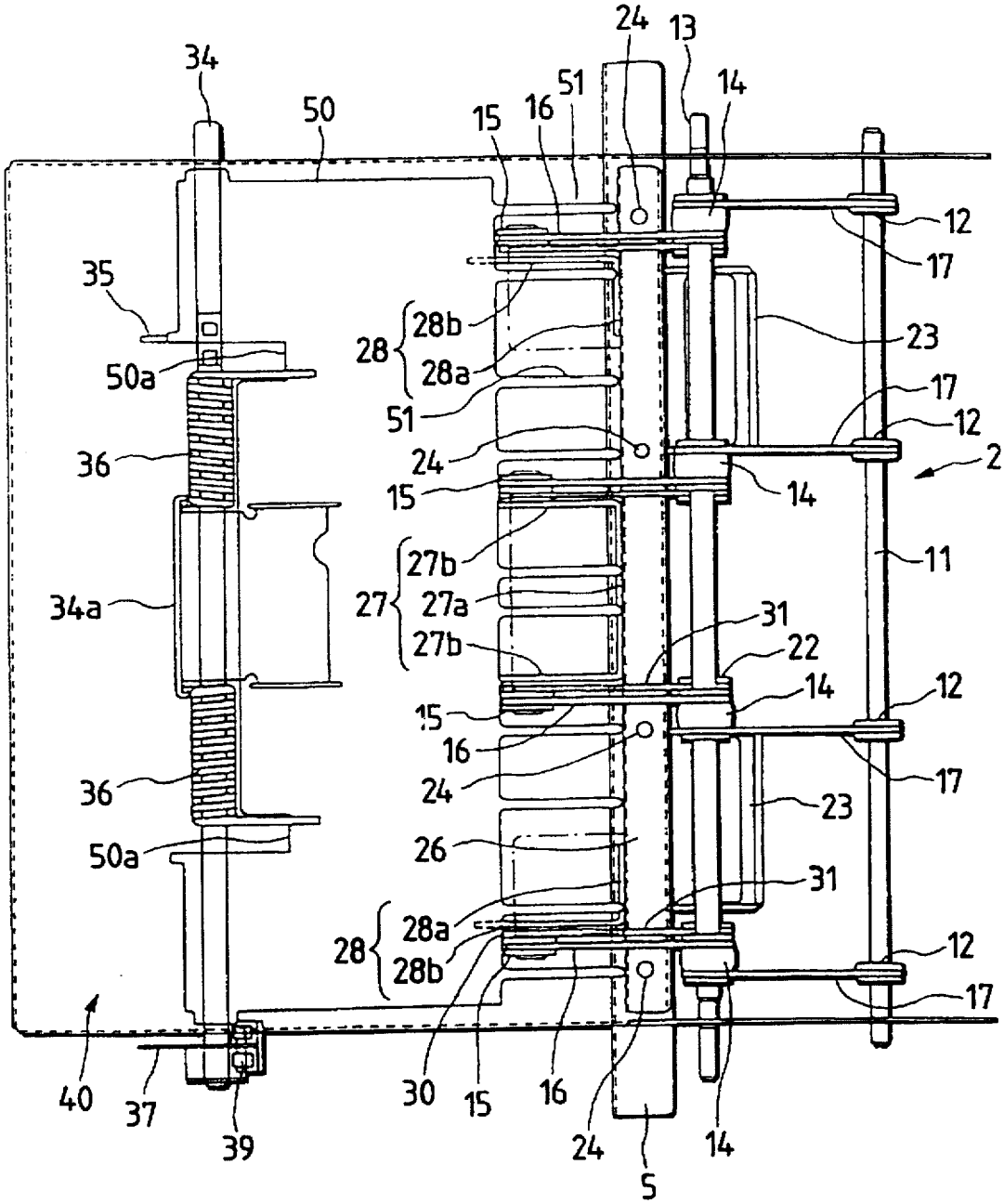
FIG. 3 is a top view of the stencil discharging apparatus shown in FIG. 1.

As shown in FIGS. 2 and 3, the third upper pulleys 15 are in alignment with the second upper pulleys 14, respectively, as viewed axially, and belts 16 are laid over those pulleys 14 and 15. Similarly, the second upper pulleys 14 are in alignment with the first upper pulleys 12, respectively, as viewed axially, and belts 17 are laid over those pulleys 12 and 15. Hence, as the second upper rotary shaft 13 is turned, the first upper pulleys 12, the second upper pulleys 14, and the third upper pulleys 15 are turned in the same direction, and accordingly the belts 16 and 17 are driven in the same direction. In FIG. 2, those pulleys 12, 14 and 15, and the belts 16 and 17 are turned clockwise.

On the other hand, the second conveying means 20, as shown in FIG. 2, is provided on a structure 5 of the stencil printing machine 100. The structure 5 is in parallel with the rotary shafts 11, 13 and 15, and is substantially L-shaped in section.

As shown in FIGS. 2 and 3, four cylindrical pillars 24 are fixedly mounted on the upper surface of the structure 5 at predetermined intervals. Coil springs 25 serving as urging means are put on those pillars 24, respectively, and a plate member 26 is mounted on the pillars 24 through the coil springs 25.

As shown in FIG. 2, the plate member 26 is U-shaped in section. That is, it is formed by bending both end portions of an elongated thin plate at right angles in the same direction. The plate member 26 has four through-holes in its middle portion at predetermined intervals. The aforementioned pillars 24 are inserted into those through-holes, and the plate member 26 is supported by the coil springs 25. When the plate member 26 is pushed downwardly, then the plate member 26 is urged upwardly by the elastic forces of the coil springs 25.

As shown in FIG. 2, a first lower rotary shaft 21 is rotatably mounted through a supporting member 29 on the surface of the plate member 26 which is on the side of the rotary cylindrical drum 101. The first lower rotary shaft 21 is positioned immediately below the above-described second rotary shaft 13 in such a manner that it is in parallel with the second rotary shaft 13. Four first lower pulleys 22 are mounted on the first lower rotary shaft 21 at predetermined intervals, and are therefore vertically adjacent to the second upper pulleys 14.

As shown in FIGS. 2 and 3, three supporting members 27, 28 and 28 are fixedly provided on the other side of the plate member 26 which is opposite to the side where the drum 101 is provided (on the left side of the plate member 26 in FIG. 3). The central supporting member 27 includes a middle base portion **27*a*, and right and left supporting portion 27*b* and 27*b* which extend forwardly from both ends of the base portion 27*a*. Each of the right and left supporting members 28 and 28 includes a base portion 28*a* and a supporting portion 28*b* which extends forwardly from one end of the base portion 28*a***.

As shown in FIGS. 2 and 3, four second lower pulleys 30 are provided on the supporting portions **27*b*, 27*b*, 28*b* and 28*b* of the supporting members 27, 28 and 28, respectively. More specifically, those four second lower pulleys 30 are rotatably mounted on those supporting portions 27*b* and 28*b* through their own rotary shafts. The rotary shafts of the second lower pulleys 30 are independent of one another; however, they are on one and the same axis. The second lower pulleys 30 are in contact with the third upper pulleys 15. The coil springs 25 are compressed which support the plate member 26 to which the second lower pulleys 30 are coupled. Hence, the second lower pulleys 30 press the third upper pulleys 15 suitably with the aid of the elastic forces of the coil springs 25**.

The plate member 26 is made of a metal plate which shows a certain elasticity against a bending force applied thereto. Hence, the three supporting members 27, 28 and 28 mounted on the front wall of the plate member 26 can be individually displaced by restorably deforming the corresponding portions of the plate member 26. Accordingly, the four second lower pulleys 30 mounted on those supporting members 27, 28 and 28 also can be moved individually. The central two of the four second lower pulleys 30 are mounted on one and the same supporting member 27. Therefore, the motion of one of those two pulleys 30 affects that of the other; however, the other pulley 30 is not always moved in the same way as the one pulley 30.

As shown in FIGS. 2 and 3, the first lower pulleys 22 are in alignment with the second lower pulleys 30 as viewed 20 axially, and belts 31 are laid over the first and second lower pulleys 22 and 30. The belts are moved over the plate member 26 and through cuts formed in the front wall of the plate member 26. As the first lower rotary shaft 21 is turned, the first lower pulleys 22, the second lower pulleys 30, and the belts 31 are turned in the same direction. In FIG. 2, the pulleys 22 and 30, and the belts 31 are turned counterclockwise.

The supporting boards 4 which support the third upper pulleys 15, and the supporting portions **27*b* and 28*b* which support the second lower pulleys 30 are arranged symmetrical with respect to the central line of the stencil which is in parallel with the stencil conveying direction. Hence, the stencil being conveyed will not be staggered by the supporting boards 4 or by the supporting portions 27*b* and 28*b*; that is, it is smoothly moved along the supporting boards 4 and the supporting portions 27*b* and 28*b***.

It is preferable that the above-described belts 16, 17 and 31 be formed with a material which is high in durability, in solvent resistance, and in friction, and which is scarcely deformed. In addition, it is preferable that the pulleys 12, 13, 15, 22 and 30 are also made of a material such as polyacetal which is high in solvent resistance and in friction.

As shown in FIGS. 2 and 3, two separating pawls 23 are provided below the first lower rotary shaft 21, to separate a stencil from the rotary cylindrical drum 101. The separating pawls 23 are fixedly secured to the structure 5 in such a manner that their wedge-shaped end portions extend towards the drum 101. When the stencil clamping member 102 is released, the front end portion of the printing stencil S wound on the drum 101 is set free. When, under this condition, the drum 101 is turned, the front end portion of the stencil S is led in between the first conveying means 10 and the second conveying means 20 while being guided by the two separating pawls 23.

As shown in FIGS. 2 and 3, the lid member 3, on which the first conveying means 10 is provided, has the used-stencil compressing board 50 serving as compressing means in such a manner that the used-stencil compressing board 50 is swingable about a shaft 34 through a predetermined angle. The used-stencil compressing board 50 is located downstream of the first conveying means 10 as viewed in the stencil conveying direction of the first conveying means 10. The home position of the board 50 is as shown in FIG. 2. The board 50, when located at the home position, will not interfere with the conveyance of the stencil S by the used-stencil conveying unit 2.

Figure 4:
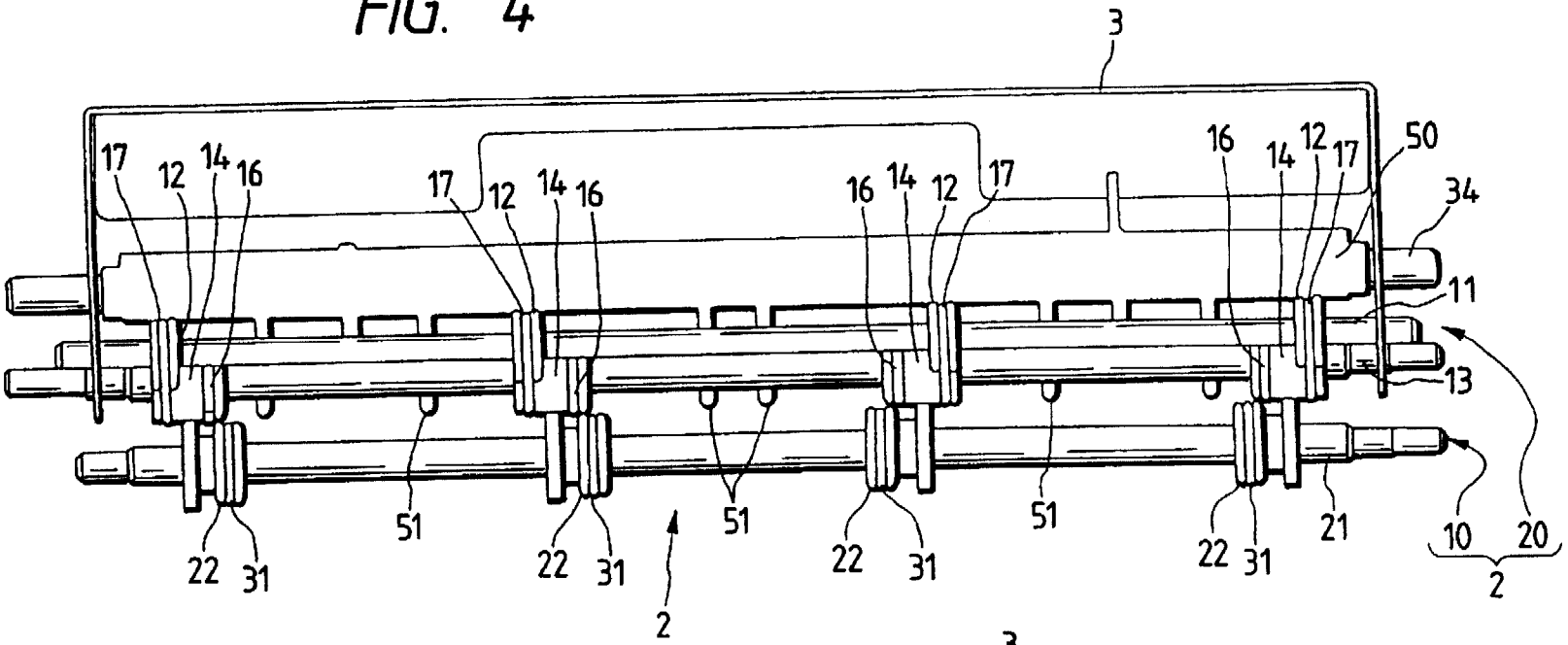
FIG. 4 is a side view of the stencil discharging apparatus as viewed from the side of the rotary cylindrical drum of the stencil printing machine.
Figure 5:
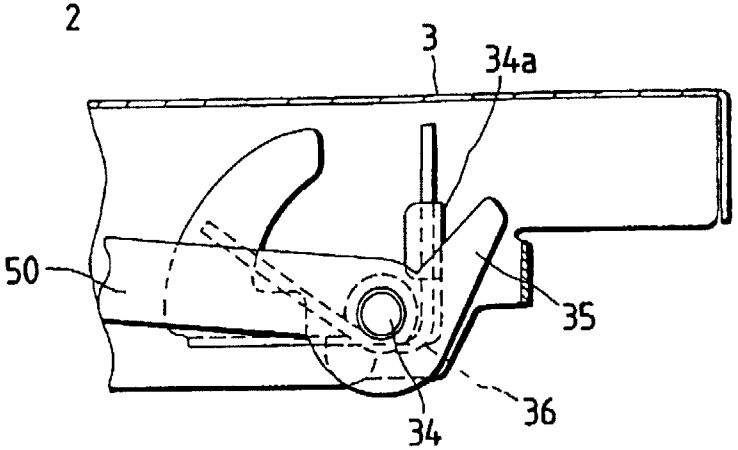
FIG. 5 is an enlarged diagram showing the base part of a used-stencil compressing board and its relevant components, as viewed from above in FIG. 3.

As shown in FIGS. 2 through 4, the rear end portion of the used-stencil compressing board 50 is mounted on the shaft 34 coupled to the lid member 3 in such a manner that the board 50 is swingable about the shaft 34. As shown in FIGS. 3 and 5, two springs 36 are mounted on the shaft 34. First end portions of the springs 36 are both engaged with a plate member **34*a* secured to the shaft 34, and the remaining end portions are engaged with cuts 50 *a* formed in the rear end portion of the used-stencil compressing board 50, respectively. When the compressing board 50 is at the home position, it is urged downwardly by the elastic forces of the springs 36**.

A plurality of scraping ribs 51 extend from the front edge of the used-stencil compressing board 50 in such a manner that they do not interfere with the above-described used-stencil conveying unit 2. Each of the scraping ribs 51 is in the form of a triangle which is protruded downwardly. As shown in FIG. 2, the used-stencil accommodating container 40 for accommodating used stencils S has a peripheral wall which extends along the locus of swinging movement of the outer end of the used-stencil compressing board 50. This structure prevents a stencil from being caught in the gap between the used-stencil accommodating container 40 and the scraping ribs 51 of the compressing board 50. That is, the used-stencil compressing board 50 is able to positively move and compress the stencil in the container 40.

As was described above, the scraping ribs 51 are triangular. Hence, as the board 50 is swung, the stencil can be positively taken into the used-stencil accommodating container 40 and compressed, and the stencil thus compressed can be moved towards the shaft 34 located in the upper portion of the inner part of the container 40. Therefore, a number of used stencils can be accommodated and compressed in the container 40. It is not always necessary that the scraping ribs 51 are triangular; however, it is preferable that the scraping ribs are so shaped as to provide the above-described effects. The inner surface of the used-stencil compressing board 50, which is on the side of the used-stencil accommodating container 40, is ribbed like a grid, so as to prevent a stencil stained with ink from sticking onto the inner surface of the compressing board 50.

Figure 8:
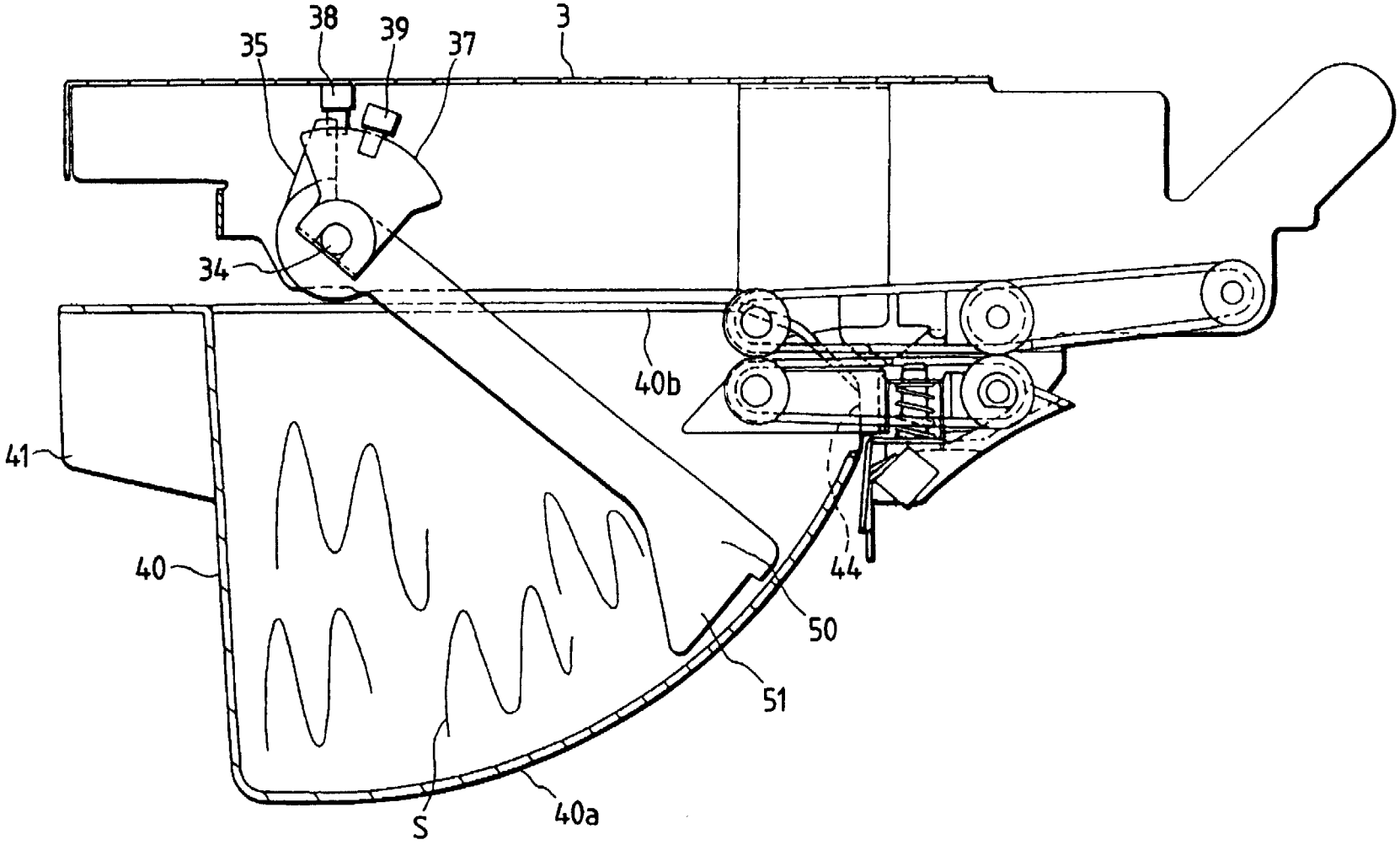
FIGS. 8, 9 and 10 are diagrams for a description of the operation of the stencil discharging apparatus shown in FIG. 1.

As shown in FIGS. 2 and 3, a protrusion 35 extends from a part of the used-stencil compressing board 50 which is near the shaft 34. More specifically, the protrusion 35 extends towards the lid member 3 so as to detect the angular position of the board 50. The protrusion 35 of the board 50 is detected with a fill-up sensor 38 as shown in FIG. 8.

Figure 9:
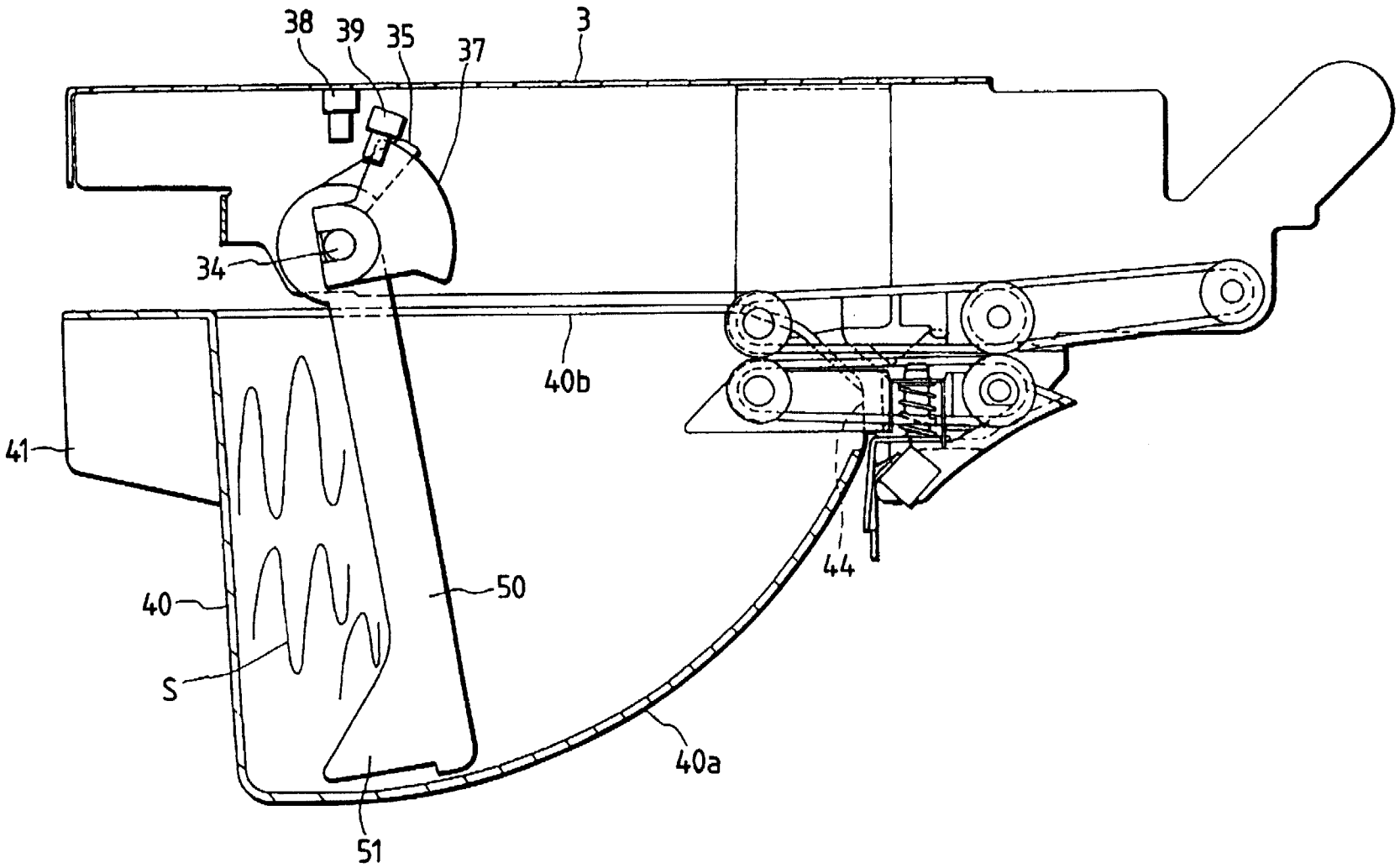
Figure 10:
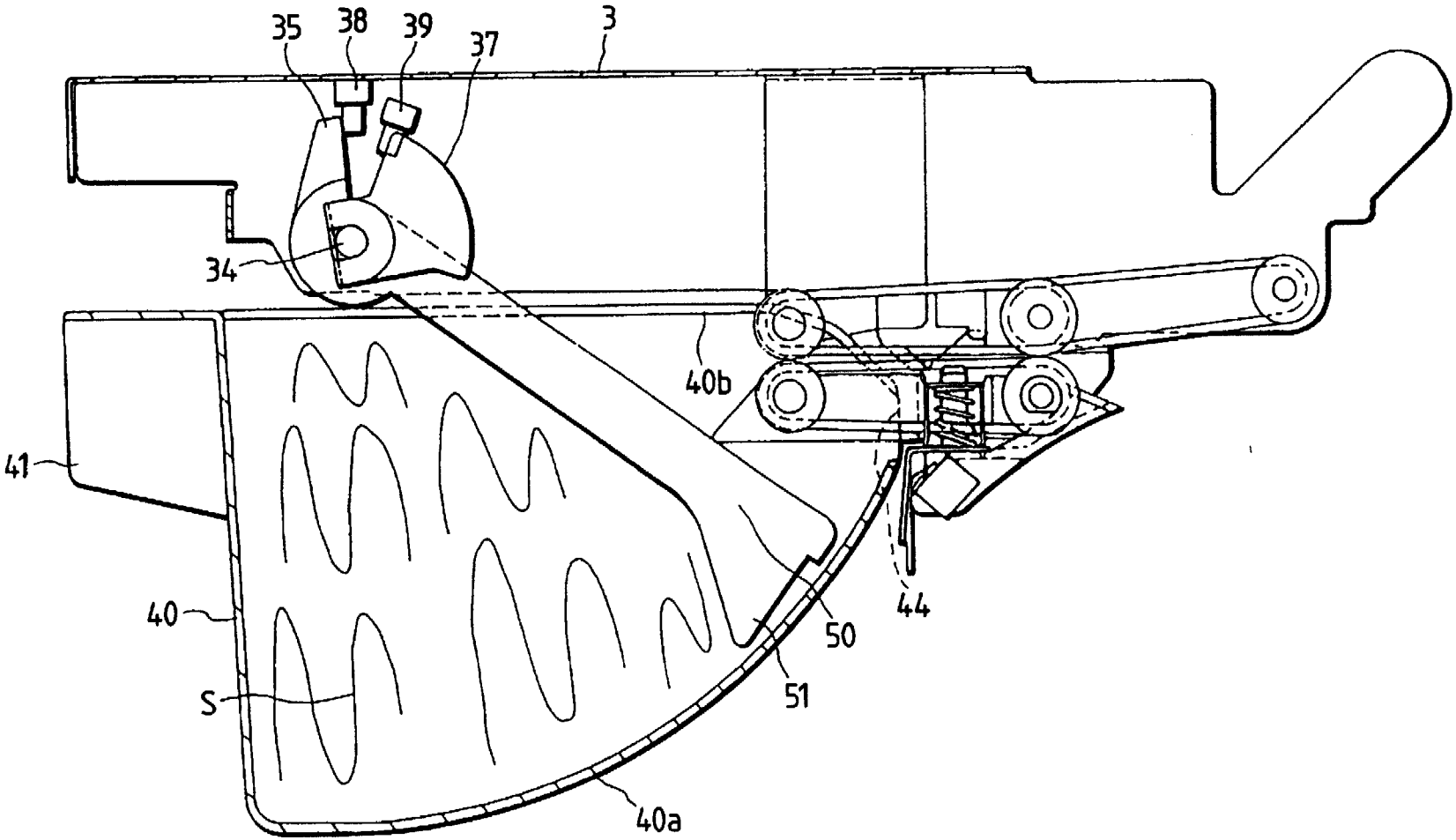

As shown in FIGS. 2 and 3, a detection board 37 is fixedly secured to the shaft 34 to detect the angular position of the shaft 34. The detection board 37 is detected with a compression sensor 39 as shown in FIGS. 2, 8 and 9.

As shown in FIG. 2, a used-stencil accommodating section, namely, a used-stencil accommodating container 40 adapted to accommodate used stencils is provided next to the above-described used-stencil conveying unit 2 and below the used-stencil compressing board 50. In the embodiment, the used-stencil accommodating container 40 has a configuration similar to the solid object which is obtained as follows: When a circular cylinder is divided into four parts with two planes which are perpendicular to each other and includes two diameters which are perpendicular to each other on the circular end face, then the resultant four parts are each a solid body whose section is a sector with a central angle of 90° (substantially a quarter division of a column). That is, the used-stencil accommodating container 40 has a bottom surface and a front surface which are part of the cylindrical wall of the circular cylinder, namely, a curved wall **40*a*. Furthermore, the container 40 has a rear wall which is substantially rectangular, and both end walls which are substantially sectorial. However, it has no top wall; that is, it has an opening 40b through which used stencils are put in the container 40**.

The configuration of the curved wall 40a of the container 40 is substantially conformable with the locus of the end of the used-stencil compressing board 50 which is swung about the shaft 34. And the stencil accommodating space in the container 40 is substantially equal to the space which the compressing board 50 occupies when swung. Hence, the used stencils S accommodated in the container 40 are positively compressed by the compressing board 50 which is moved while substantially wiping the inner surfaces of the walls of the container 40.

Figure 6:
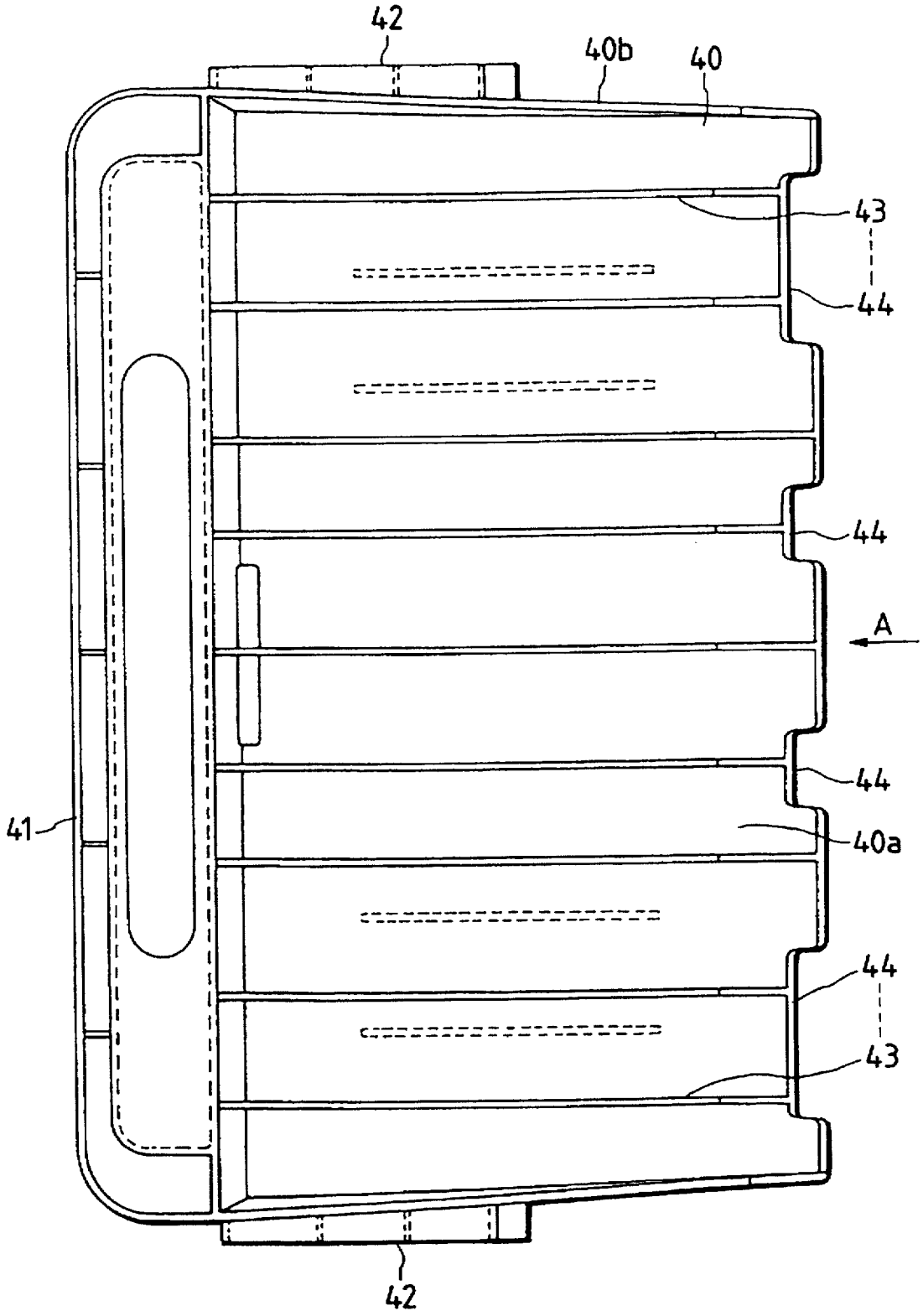
FIG. 6 is a top view of a used-stencil accommodating container in the stencil discharging apparatus shown in FIG. 1.

FIG. 6 is a top view of the used-stencil accommodating container 40. For convenience in description, hereinafter, the direction which is in parallel with the surface of the stencil conveyed (corresponding to the surface of the drawing of FIG. 6) and perpendicular to the stencil conveying direction "A" will be referred to as "a direction of first width", when applicable. The first width of the used-stencil accommodating container 40 is gradually larger in the stencil conveying direction; in other words, it is gradually larger in the direction in which the used-stencil compressing board 50 is moved to compress the used stencils.

As was described above, the configuration of the curved wall 40a of the container 40 is substantially conformable with the locus of the end of the used-stencil compressing board 50 which is swung about the shaft 34. In this connection, for convenience in description, the direction which is perpendicular to the surface of the stencil S being conveyed (corresponding to the surface of the drawing of FIG. 2), will be referred to as "a direction of second width", when applicable. The second width of the container 40 is gradually larger in the direction in which the used-stencil compressing board 50 is moved to compress the used stencils.

The used-stencil accommodating container 40 shaped as described above provides the following effects or merits: The container 40 can be readily loaded in or unloaded from the printing machine body. In compressing the used stencils with the compressing board 50, a large space is provided in the container to accommodate used stencils. When the board 50 is returned, it is hard for the used stencils compressed in the container to move back towards the opening 40b.

As shown in FIG. 6, the used-stencil accommodating container 40 has a pair of guides 42 on both sides which are engaged with a pair of slits (not shown) formed on the inner wall of the stencil printing machine body. The container 40 can be moved substantially horizontally with respect to the stencil printing machine body with the aid of the guides 42 and the slits; that is, it can be freely loaded in and unloaded from the printing machine body. The container 40 has a handle 41 on its back which the operator grips to load the container in the printing machine body or unload the container 40 from the printing machine body. The printing machine body is provided with a sensor or the like which detects the position of the container to output a detection signal. The detection signal is utilized to determine whether or not the container 40 is set in position.

Figure 11A:
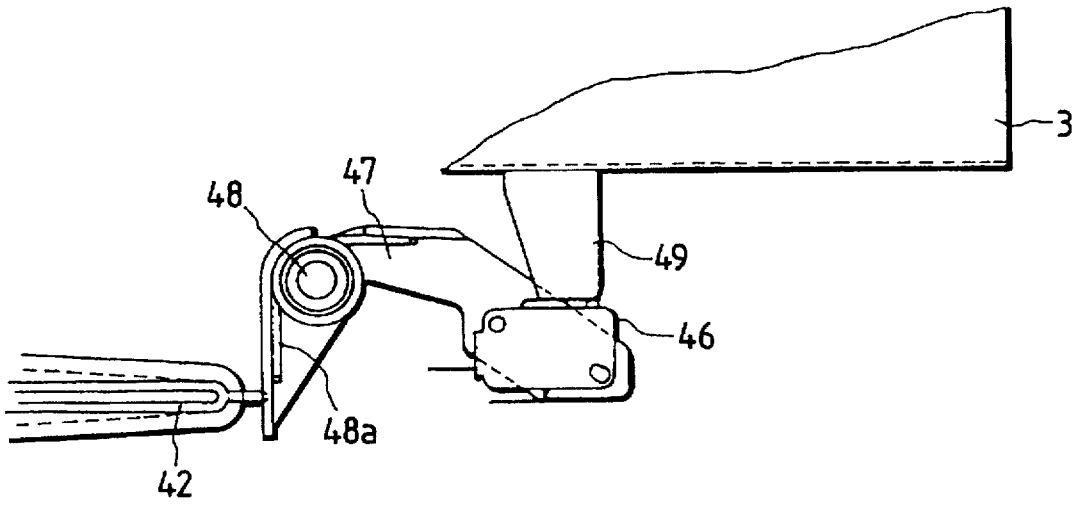
FIGS. 11(*a*) and 11(*b*) are diagrams for a description of the used-stencil accommodating container loading and unloading operations of the stencil discharging apparatus shown in FIG. 1.
Figure 11B:
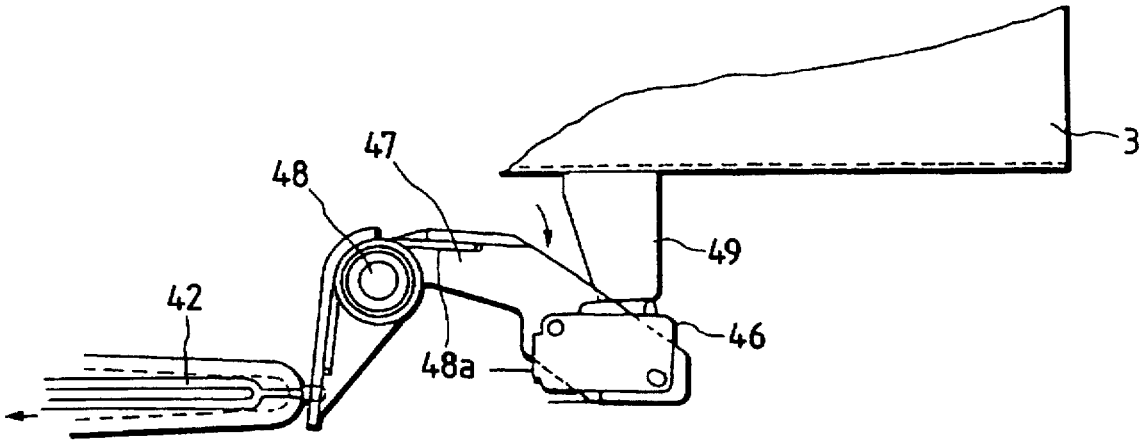
Figure 12:
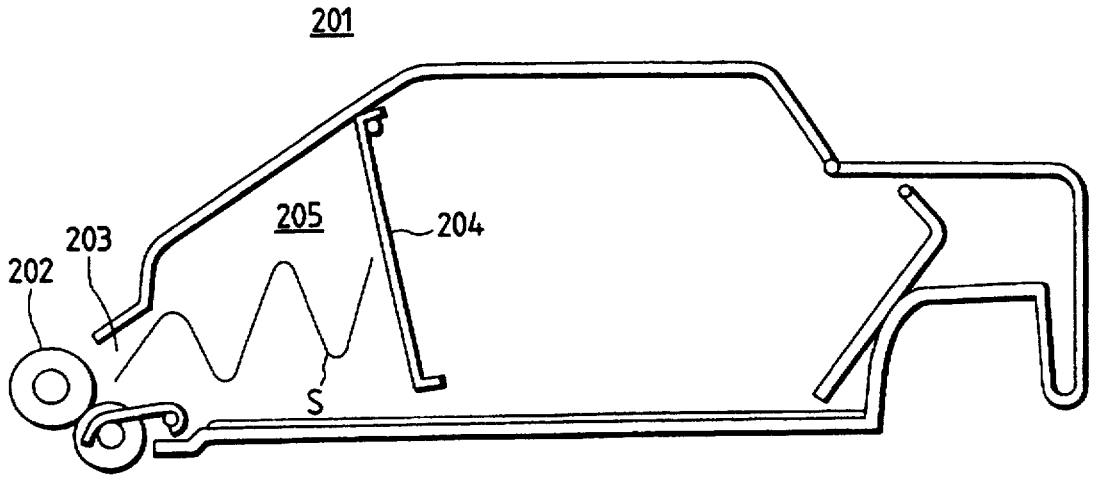
FIG. 12 PRIOR ART
FIGS. 12 and 13 are diagrams for a description of a conventional stencil discharging apparatus.
Figure 13:
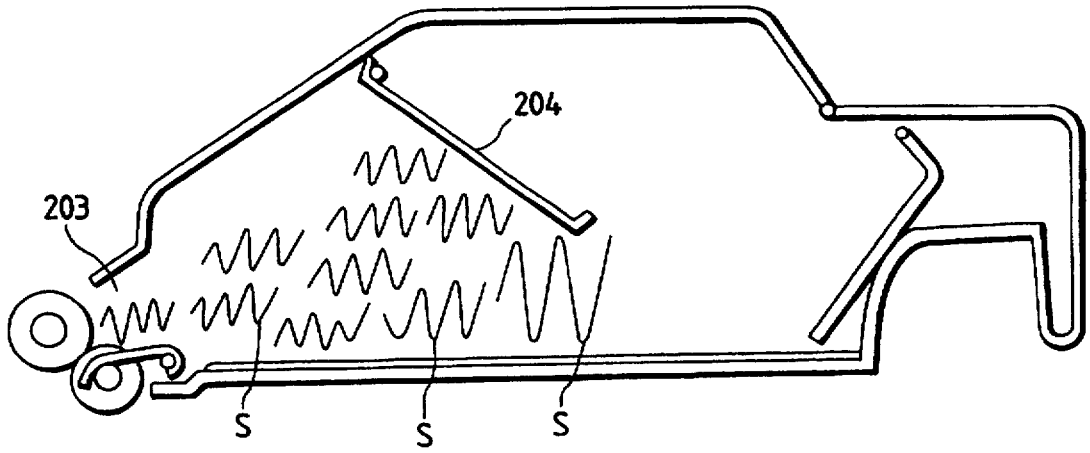
FIG. 13 PRIOR ART

As shown in FIG. 11, the stencil printing machine body, in which the used-stencil accommodating container 40 is loaded, has an L-shaped mounting board 47 which is swingably mounted on a shaft 48 through its angled corner. The board 47 has a stencil-discharging-pressure-board switch 46 at one end. The switch 46 is urged upwardly by a torsion coil spring 48a which is mounted on the shaft 48. The lid member 3 has a protrusion 49. When the lid member 3 is closed, the protrusion 49 directly pushes the actuator of the switch 46 which is set at a predetermined position. On the other hand, when the container 40 is loaded in the printing machine body, the guide 42 of the container 40 pushes the other end of the L-shaped mounting board 47 to swing the mounting board 47 in the direction in which the switch is urged by the coil spring 48, to set the switch 46 at the above-described predetermined position. Hence, the lid member switch 46 is able to determine whether the lid member 3 is opened or whether it is closed, and whether the container is set in the printing machine body or whether it is not. In other words, the switch 46 is turned on only if the lid member 3 is closed and the container 40 is loaded.

As shown in FIG. 6, the used-stencil accommodating container 40 has a plurality of ribs 43 (nine ribs in the embodiment) on the inner surface. More specifically, those ribs 43 are so positioned that they do not interfere with the above-described scraping ribs 51. The ribs 43 are to prevent the used stencils S accommodated in the container 40 from being widely stuck onto the inner surface of the container 40; that is, they function to allow the compressing board 50 to smoothly perform the conveyance and compression of used stencils. The container 40 has a cut 44 in the upper portion of the curved wall 40a so that the container 40 may not interfere with the used-stencil conveying unit 2 when the container is loaded in or unloaded from the printing machine body.

As shown in FIG. 2, when the container 40 is loaded in the printing machine body, the portion of the used-stencil conveying unit 2 which is located downstream as viewed in the stencil conveying direction (hereinafter referred to as "a downstream portion", when applicable) is located at the front end portion of the opening 40b of the container 40. The downstream portion of the conveying unit 2 includes the second lower pulleys 30, the supporting portions 27b and 28b which support the pulleys 30, the third upper pulleys 15, and the belts 16 and 31. The front end portion of the opening 40b of the container where those members are located is the region through which the front end portion of the used-stencil compressing board 50 is moved. Hence, the downstream portion of the used-stencil conveying unit 2 which includes the supporting portions 27b, 28b, etc. serves as means for preventing the used stencils S accommodated in the container 40 from being moved out of the container 40 through the opening 40b. This will be described in more detail.

The compressing board 50 is returned to the home position after compressing the used stencils S in the container 40. In this operation, a used stencil or stencils may stick to the compressing board 50; that is, they may be moved out of the container 40 together with the compressing board 50. However, the embodiment is free from this difficulty, because the downstream portion of the conveying unit 20 is arranged near the front end portion of the opening 40b of the container 40 as was described above. The downstream portion thus arranged does not interfere with the front end portion of the compressing board 50 moving, and is able to retain the used stencils S in the container.

As shown in FIG. 2, the above-described structure 5 has a master sensor 32 on its vertical wall. The master sensor 32 is to determine whether or not a stencil S is on the outer cylindrical surface of the rotary cylindrical drum 101.

Now, the stencil discharging operation of the stencil discharging apparatus, in the stencil printing machine will be described.

The stencil discharging operation is started when a stencil making button is depressed, or a secrecy operation button is depressed (a button for an operation of winding a stencil on the drum 101 which is not a printing stencil yet). For instance, when a start button (not shown) is depressed with a given original placed on the original stand, the drum 101 is turned counterclockwise in FIG. 1. While the drum 101 is being turned in this way, the above-described master sensor 32 determines whether or not a stencil S is on the outer circumferential surface of the drum 101.

When the stencil clamping member 102 comes to the top 20 position after the presence of a stencil is detected; that is, after it is determined that a stencil to be discharged is on the drum, the rotation of the drum 101 is stopped. Under this condition, the stencil clamping member 102 is opened to release the front end portion of the stencil S.

Simultaneously when the stencil S is released in this way, the second upper rotary shaft 13 or the first lower rotary shaft 21 is driven by drive means (not shown), so that the used-stencil conveying unit 2 is driven in the stencil conveying direction. In this operation, the stencil S thus released curls; however, the rising of the front end portion of the stencil S is suppressed by the first upper pulleys 12 and by the belt 17 laid over the first upper pulleys 12.

The drum 101 is turned counterclockwise. The stencil S with its front end portion raised is forwarded to the conveying unit 2 while being guided by the separating pawls 23. The stencil S thus forwarded is conveyed towards the used-stencil accommodating container 40 by the conveying unit 2, thus being separated from the drum 101. When the stencil clamping member 102 turns together with the drum 101 through about 90° from the position where the stencil is laid on or removed from the drum.101 (hereinafter referred to the position where the stencil is laid on or removed from the drum 101 as "a stencil laying position", when applicable), the aforementioned master sensor 32 determines again whether or not a stencil is on the outer circumferential surface of the drum 101. When no stencil is on the drum 101, then it is determined that the stencil has been forwarded to the conveying unit 2. When a stencil is on the drum 101, then the drum 101 is turned through 270° (to the stencil laying position), and an alarm signal is produced to indicate that an error occurs in the stencil discharging operation; i.e., the stencil is not removed from the drum 101. At the same time, the used-stencil conveying unit 2 is stopped.

The stencil thus separated from the drum 101 is conveyed by the conveying unit 2. As shown in FIG. 4, the stencil is held pushed substantially by the pulleys from above and from below, and the belts serve as guides to convey the stencil.

As shown in FIG. 2, a jamming sensor 45 is provided above the plate member 26; more specifically, it is mounted on the lid member 3. The jamming sensor 45 is operated by an actuator provided on the stencil conveying path. In the embodiment, the jamming sensor 45 is positioned above the middle of the plate member 26 as viewed in the longitudinal direction of the plate member 26; however, the invention is not limited thereto or thereby. That is, it may be positioned at any point on the stencil conveying path. The jamming sensor 45 is turned on by the front edge of the stencil S thus conveyed, and it is kept turned on until the stencil S passes through it. That is, when the stencil passes through the jamming sensor 45, the jamming sensor 45 is turned off.

A stencil compressing operation is started when the following condition is satisfied: when, after the master sensor 32 detects the absence of a stencil; i.e., when it determines that no stencil is on the drum 101 (the stencil S has been forwarded to the conveying unit) while the drum 101 turns through 90° from the stencil laying position, the drum 101 turns through 270° to the stencil laying position again, the jamming sensor 45 is off (the stencil S has been accommodated in the container 40).

The used-stencil compressing board 50 is held at its home position until the stencil S enters the used-stencil accommodating container 40. In this case, as shown in FIG. 2, the protrusion 35 of the compressing board 50 does not turn on the full-up sensor 38 yet, and the detection board 37 does not turn on the compression sensor 39.

The compressing board 50 is swung clockwise around the shaft 34. More specifically, the compressing board 50 is swung along the inner surfaces of the used-stencil accommodating container 40, to positively compress the stencils in the container 40 and move them into the inner part thereof. FIG. 8 shows the used-stencil compressing board 50 which is compressing the stencils S in the container 40. While the board 50 compresses the stencils S in the container 40 in this way, the detection board 37 turns on the compression sensor 39 as shown in FIG. 8.

The compressing board 50 is further turned from the position shown in FIG. 8, to further compress the stencils S. The stencils S thus compressed are moved upwardly, or towards the shaft 34, in the container 40 by the scraping ribs 51 of the compressing board 50. When the used-stencil compressing board 50 reaches a predetermined position as shown in FIG. 9, the detection board 37 is disengaged from the compression sensor 39, so that the sensor 39 is turned off. FIG. 9 shows the compressing board 50 which has maximumly compressed the stencils S in the container 40. When the compression sensor 39 is turned off, the swing of the compressing board 50 is stopped.

The motor (not shown) coupled to the shaft 34 is turned in the reverse direction, so that the compressing board 50 is swung back. As a result, the compression sensor 39 is turned on by the detection board 37. When the compressing board 50 is further swung back, the compression sensor is turned off. Finally, the compressing board 50 is returned to the home position as shown in FIG. 2. That is, the compressing board 50 is stopped so as to be positioned at its home position a predetermined period of time after the compression sensor 39 is turned off in the above-described manner. The reason why the compressing board 50 is not stopped immediately after the compression sensor 39 is turned off is that, if the compression sensor 39 is turned on, for instance, by the vibration of the stencil printing machine, then it takes time to confirm the position of the compressing board 50 in the initial setting operation.

As the number of used stencils is increased in the used-stencil accommodating container 40; that is, when the container 40 is filled up with the used stencils, then it becomes impossible to further move the compressing board 5 inwardly. In this case, even if the shaft 34 driven by the motor is turned; that is, even if the detection board 37 secured to the shaft 34 is turned together with the shaft 34 to pass through the compression sensor 39, the compressing board 50 cannot be moved being obstructed by the stencils S filled in the container 40. Accordingly, the protrusion 35 integral with the compressing board 50 cannot be swung; that is, it cannot turn on the full-up sensor 38. In the case where, during the stencil compressing operation, the compression sensor 39 is turned off before the full-up sensor 38 is turned on, it is determined that the container 40 has been filled up with the stencils.

When it is determined that the container 40 has been filled up with the stencils, then "STENCIL DISCHARGING OVER" is displayed with LEDs on the operating panel (not shown).

In the case where, as shown in FIG. 11(*a*), the lid member 3 is closed, and the container 40 is loaded in the printing machine body, the mounting board 47 is pushed by the guide 42, and the stencil-discharging pressure board switch 46 is set at the predetermined position. That is, the switch 46 is turned on by the protrusion 49 of the lid member 3. When the container 40 is unloaded from the printing machine body, then as shown in FIG. 11(*b*) the mounting board 47 is turned clockwise, so that the switch 46 is disengaged from the protrusion 49 of the pressure board 3; that is, it is turned off. Thereafter, the stencils S are manually removed from the container 40 thus unloaded, and the emptied container 40 is loaded in the printing machine body again. As was described before, the switch 46 is turned on only when the container is loaded in the printing machine body and when the pressure board is closed. In the case where there is a predetermined period of time between the time instant that the switch 46 is turned off and the time instant that it is turned on again, it is determined that the stencils S have been removed from the container 40, and the above-described display "STENCIL DISCHARGING OVER" is stopped. In this case, when it is detected that the stencil-discharging pressure plate switch 46 is turned on, the conditions of the stencil discharging apparatus which has achieved the stencil discharging operation should be confirmed by moving the compressing board 50 downwardly again. This confirmation has the following effect: even if, under the condition that the stencils are not removed from the container 40; that is, the container 40 is filled up with the stencils, the next stencil discharging operation is carried out, stencils will never be jammed in the stencil discharging apparatus.

Now, a procedure of detecting the position of the compressing board 50 when the power switch of the stencil printing machine is turned on. When the power switch of the printing machine is turned on, the compressing board 50 is (1) at the home position (as shown in FIG. 2), or (2) at a maximum compression position (as shown in FIG. 9), or (3) at a position between the home position and the maximum compression position (as shown in FIG. 8).

(1) In the case where the compressing board 50 is at the home position as shown in FIG. 2, the compression sensor 39 is in the "off" state. First, the compressing board 50 is turned clockwise (in FIG. 2) with the motor (not shown), and then stopped when the compression sensor 39 is turned on. The motor is turned in! the reverse direction, and is then stopped a predetermined period of time (50 ms) after the compression sensor 39 is turned off.

(2) In the case, too, where the compressing board 50 is at the maximum compression position as shown in FIG. 9, the compression sensor 39 is in the "off" state. The rear end of the detection board 37 is disengaged downwardly from the compression sensor 39. First, the compressing board 50 is turned clockwise (in FIG. 9) with the motor (not shown). If the compression sensor 39 is not turned on even in a predetermined period of time (360 ms), the motor is stopped, and then turned in the opposite direction. It is confirmed that the compression Sensor 39 is turned on. And, the motor is turned in the same direction until the compression sensor 39 is turned off. After the compression sensor 39 is turned off in this manner, similarly as in the above-described case (1) the motor is stopped in the predetermined period of time.

(3) In the case where the compressing board 50 is located between the home position and the maximum compression position as shown in FIG. 8, the compression sensor 39 is in the "on" state. The compressing board 50 is turned clockwise with the motor until the sensor 39 is turned off. When the sensor 39 is turned off, the compressing board 50 is stopped. Thereafter, the motor is turned in the opposite direction. When the sensor 39 is turned off again, similarly as in the above-described case (1) the motor is stopped in the predetermined period of time.

In the above-described embodiment, the supporting portions 27*b* and 28*b* which support the second lower pulleys 30 arranged downstream (as viewed in the stencil conveying direction) are employed as return-preventing means for preventing a stencil from returning back. However, the return-preventing means may be provided as components different from the supporting portions 27*b* and 28*b*. In this case, the return-preventing means should be so arranged that they do not interfere with the scraping ribs 51 of the used-stencil compressing board 50 moving. In addition, in order that the return-preventing means may not resist the conveyance of the stencil, the upper surfaces of the return preventing means should be below the upper surfaces of the supporting portions 27*b* and 28*b*; and in order that the stencil may not be caught by the belts, the lower surfaces of the return-preventing means should be below the belts.

Figure 7:
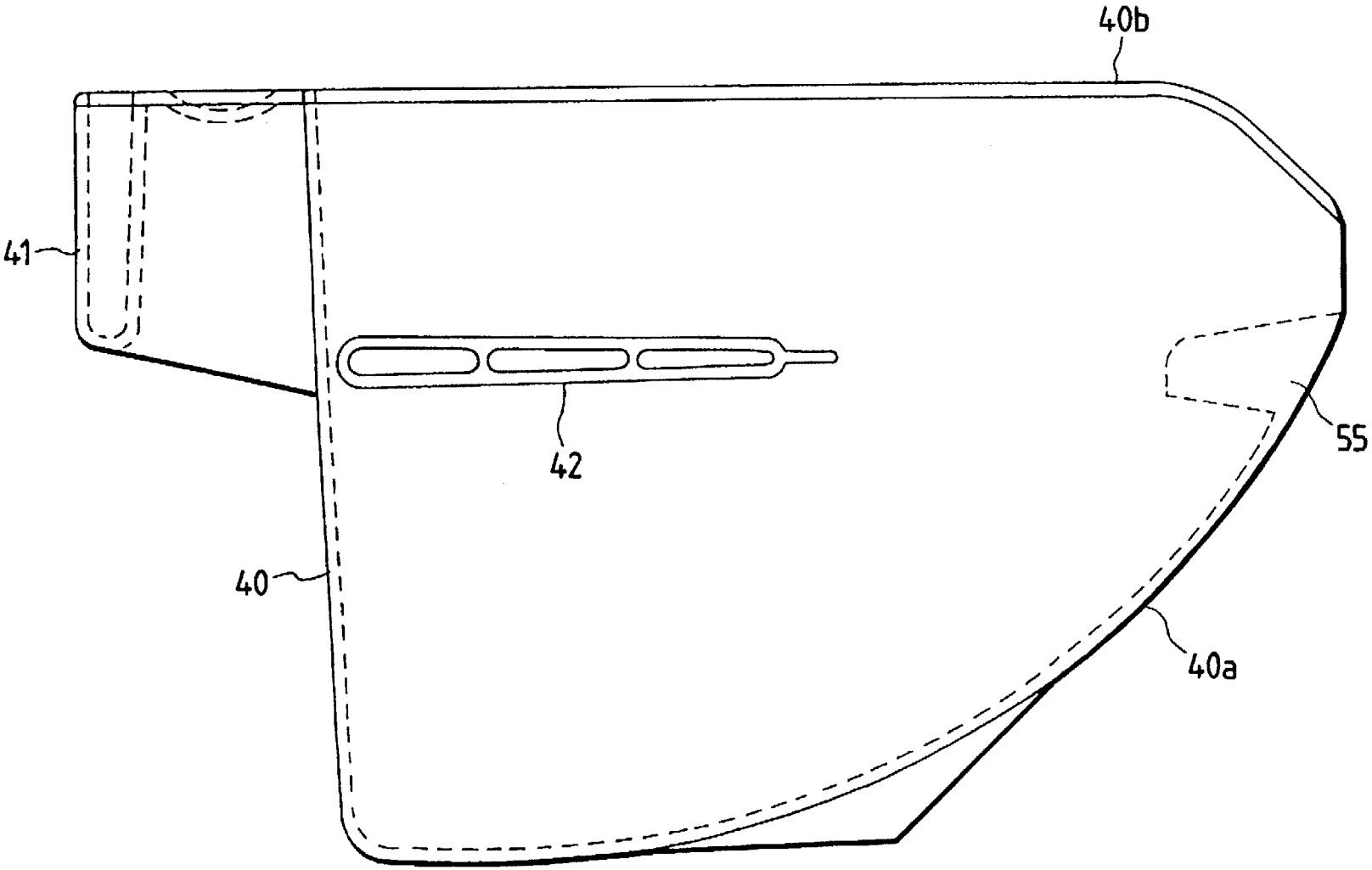
FIG. 7 is a diagram of a used-stencil accommodating box in the stencil discharging apparatus shown in FIG. 1, as viewed in a direction which is perpendicular to its loading direction.

In the above-described embodiment, the predetermined portion of the used-stencil conveying unit 2, which includes the supporting portions 27*b* and 28*b* supporting the second lower pulleys 30, is employed as the return-preventing means for preventing a stencil from returning back. Instead of the return-preventing means, pawl-shaped protrusions 55 may be employed which, as shown in FIG. 7, are formed on the inner surface of the curved wall 40*a* of the used-stencil accommodating container 40 near the front end of the opening 40*b* of the container 40. The protrusions 55 must be so arranged that they do not interfere with the scraping ribs 51 of the compressing board 50 moving. The protrusions 55 are also able to detain the stencils in the container 40 when the compressing board 50 is swung back from the container 40.

With the stencil discharging apparatus of the invention, the stencils S stained with printing ink or the like can be positively compressed and accommodated in the used-stencil accommodating section.

Since the used-stencil accommodating section is so designed that its width is gradually larger in the stencil compressing direction, the section is able to accommodated a large number of stencils.

After the compressing board compresses the stencil, the compressing board returns to the home position. In this operation, preventing means prevents the stencil from moving out of the used-stencil accommodating section.

The compressing board surely presses the stencil accommodated in the used-stencil accommodating section since the stencil accommodating space of the used-stencil accommodating section is substantially conformable with the locus of movement of the outer end of the compressing board.

What is claimed is:

1. A stencil discharging apparatus for a stencil printing machine in which a stencil is used, said stencil discharging apparatus comprising:

conveying means for conveying the stencil to be discharged;

a used-stencil accommodating section having an opening and a stencil accommodating space in which the stencil conveyed by said conveying means is accommodated; and a compressing board pivotally mounted for swinging movement and having an outer, free end, wherein said compressing board presses the stencil accommodated in said stencil accommodating space toward a side opposite to said opening of said used-stencil accommodating section in accordance with the swinging movement of said compressing board in said stencil accommodating space, wherein said used-stencil accommodating section has a curved wall which is shaped in conformance with the locus of swinging movement of the outer, free end of said compressing board.

2. A stencil discharging apparatus for a stencil printing machine in which a stencil is used, said stencil discharging apparatus comprising:

conveying means for conveying the stencil to be discharged;

a used-stencil accommodating section having a stencil accommodating space in which the stencil conveyed by said conveying means is accommodated; and compressing means, which is moved in said stencil accommodating space of said used-stencil accommodating section, for compressing the stencil in said stencil accommodating space, wherein the width of said used-stencil accommodating section as viewed in a direction which is perpendicular to the surface of the stencil being conveyed is gradually larger in a direction in which said compressing means is moved to compress the stencil, and further wherein said compressing means comprises:

a shaft; and a compressing board which is swingable about said shaft through a predetermined angle and which includes an outer, free end, wherein said used-stencil accommodating section has a curved wall which is shaped in conformance with the locus of swinging movement of the outer, free end of said compressing board.

3. A stencil discharging apparatus for a stencil printing machine in which a stencil is used, said stencil discharging apparatus comprising:

conveying means for conveying the stencil to be discharged;

a used-stencil accommodating section having an opening from which the stencil is received and a stencil accommodating space in which the stencil conveyed by said conveying means is accommodated; compressing means, which is moved in said stencil accommodating space of said used-stencil accommodating section, for compressing the stencil in said stencil accommodating space, and means for preventing the stencil accommodated in said stencil accommodating space from moving out, wherein said preventing means is mounted near said opening of said used-stencil accommodating section, and wherein said preventing means comprises a plurality of pawl-shaped protrusions formed within said used-stencil accommodating section on an inner surface thereof near said opening of said used-stencil accommodating section.

4. A stencil discharging apparatus for a stencil printing machine in which a stencil is used, said stencil discharging apparatus comprising:

a conveying unit including a series of belts and pulleys for conveying the stencil to be discharged;

a used-stencil accommodating section having an opening from which the stencil is received and a stencil accommodating space in which the stencil conveyed by said conveying unit is accommodated; and compressing means, which is moved in said stencil accommodating space of said used-stencil accommodating section, for compressing the stencil in said stencil accommodating space, wherein said conveying unit, in a part which is located downstream as viewed in the stencil conveying direction, further includes a plurality of supporting portions which support at least some of the series of belts and pulleys, said supporting portions being located at the front end portion of said opening of said used-stencil accommodating section and extending within said used-stencil accommodating section so as to prevent the stencil accommodated in said stencil accommodating space from moving out, and for inwardly pressing the stencil accommodated in said stencil accommodating space.

5. A stencil discharging apparatus according to claim 4, wherein said compressing means is mounted near said opening of said used-stencil accommodating section.

6. A stencil discharging apparatus for a stencil printing machine in which a stencil is used, said stencil discharging apparatus comprising:

conveying means for conveying the stencil to be discharged;

a used-stencil accommodating section having an opening in which the stencil conveyed by said conveying means is accommodated; and compressing means, which is swingably moved across said conveying means in said stencil accommodating space of said used-stencil accommodating section, for compressing the stencil in said used-stencil accommodating space, said compressing means comprising:

a shaft provided adjacent to said conveying means, said shaft extending substantially perpendicular to the stencil conveying direction; and a compressing board pivotable around said shaft within a predetermined angle, said compressing board including a protrusion for compressing the stencil, wherein said stencil accommodating space substantially conforms in shape with the locus of swinging movement of said compressing means, and further wherein said protrusion is triangular in cross-section such that said protrusion moves the stencil toward said shaft when said compressing board moves inside said used-stencil accommodating space.

* * * * *